United States Patent [19]

Lowe

[11] 4,099,049

[45] Jul. 4, 1978

[54] ASCENDING REGISTER LOCKOUT SYSTEM FOR A POSTAGE METER

[75] Inventor: Lynnwood Lowe, Noroton Heights, Conn.

[73] Assignee: Pitney-Bowes, Inc., Stamford, Conn.

[21] Appl. No.: 740,377

[22] Filed: Nov. 10, 1976

[51] Int. Cl.[2] ..... G07G 1/00

[52] U.S. Cl. ..... 235/101

[58] Field of Search ..... 235/101, 130 R, 132 R

[56] References Cited

U.S. PATENT DOCUMENTS

| | | | |
|---|---|---|---|
| 1,603,402 | 10/1926 | Pitney | 235/101 |
| 3,002,686 | 10/1961 | Heil et al. | 235/101 |
| 3,682,378 | 8/1972 | Rouan et al. | 235/101 |
| 3,848,798 | 11/1974 | Riley | 235/101 |

*Primary Examiner*—Stephen J. Tomsky

*Attorney, Agent, or Firm*—Robert S. Salzman; William D. Soltow, Jr.; Albert W. Scribner

[57] ABSTRACT

The invention is for an improved security system for a postage meter, which features an ascending register lockout. Most commercial postage meters contain ascending and descending registers which keep an accounting of the meter's use. The lockout for the ascending register is disposed in combination with, but functions independently from, a descending register lockout also located within the postage meter. Both lockout devices use a locking comb arrangement to sense when a postage value lockout position is reached by their respective register wheels. The descending register lockout provides a pivoting cam to block a shutter bar window when a descending register lockout condition is sensed. The ascending register lockout system provides a slide bar for blocking the shutter bar window when an ascending register lockout condition is sensed.

14 Claims, 3 Drawing Figures

ASCENDING REGISTER LOCKOUT SYSTEM FOR A POSTAGE METER

The invention pertains to postage meters and more particularly to a new ascending register and descending register lockout system combination.

BACKGROUND OF THE INVENTION

Heretofore, there has been no attempt to provide a lockout for the ascending register of a mechanical postage meter. Considering that the postage meter has been in commercial use for more than fifty years, the major improvement of an ascending register lockout is rather unique. The reason for the aforementioned improvement, revolves around the need to uniformly maintain and service the meters.

Many meters have gone through their ascending register limit many times without ever being repaired or without even requiring service. While most postage meters can go many years without being repaired, it has been determined that a uniform check-up would improve postal security. Therefore, if each postage meter was automatically disabled after a given extent of use, it could be brought back for inspection and reactivation. This would provide a uniform procedure of inspecting the postage meters at uniform intervals.

The present inventive ascending lockout system was conceived as a means of fulfilling the above objective.

SUMMARY OF THE INVENTION

The invention relates to an ascending register lockout system for a postage meter, and also for the combination of ascending and descending register lockout devices.

The ascending register lockout has been designed to work independently of the descending register lockout. Both lockout devices close the same shutter bar window, when their respective register wheels reach a given postage value limit. Each lockout system employs a pivotable locking comb, whose teeth sense the alignment of the register wheels by dropping into recessed notches in the wheels.

In the descending register lockout system, the pivoting comb will in turn pivot a link, that will free a spring-loaded cam. The cam will pivot and block a shutter bar window, preventing a machine print cycle from being initiated.

In the ascending register lockout system, the respective pivoting locking comb will cam a triggering sear, the cammed triggering sear will in turn pivot and release a spring-loaded slide bar member. When the slide bar member is released, it will slide over the shutter bar window and likewise prevent the printing cycle.

The aforementioned mechanisms are independently operative, and function in such a manner that they will not interfere with the proper working of the postage meter.

It is an object of this invention to provide an improved postage meter;

It is a further object of the invention to provide a lockout system for an ascending register of a postage meter;

It is another object of the invention to provide compatible ascending and descending register lockout systems for a postage meter;

These and other objects of this invention will be better understood and will become more apparent with reference to the following detailed description taken in conjunction with the accompanying drawings, in which.

DETAILED DESCRIPTION

Generally speaking, the invention comprises an ascending register and a descending register lockout device in combination. The ascending register has a number of counter wheels for registering a running total amount of postage being added into the postage meter. The descending register includes a number of counter wheels for registering the amount of postage being decremented with each postage printing. The descending lockout device is operatively connected between a postage printing release mechanism and the descending register. This lockout device disables the postage printing release mechanism when the descending register reaches a postage value lockout position. The ascending lockout device is operatively connected between the postage printing release mechanism and the ascending register. The ascending lockout device disables the postage printing release mechanism when the ascending register reaches a postage value lockout position.

Figure 1:
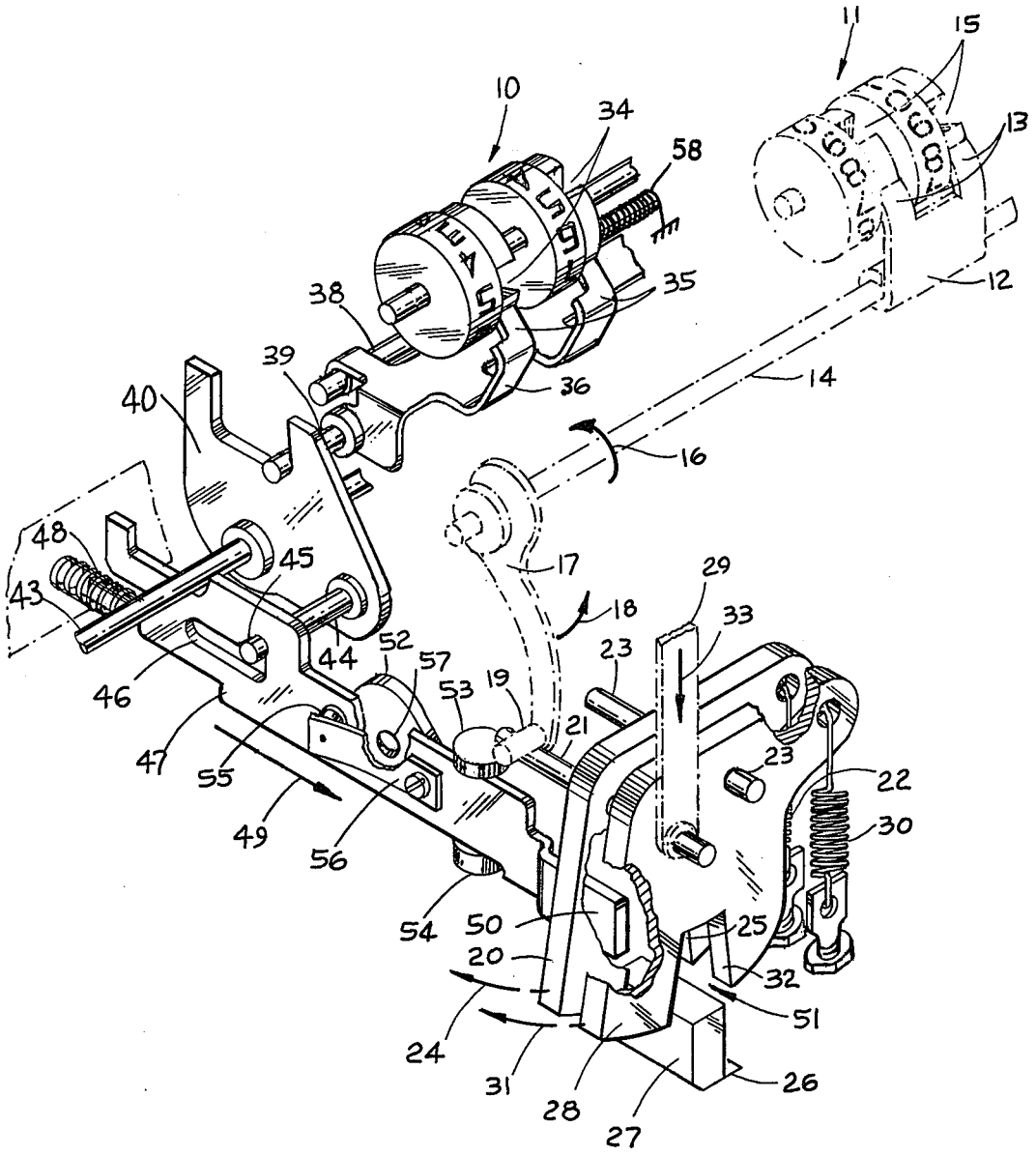
FIG. 1 is a perspective view of the ascending and descending register lockout systems of the invention.
Figure 2:
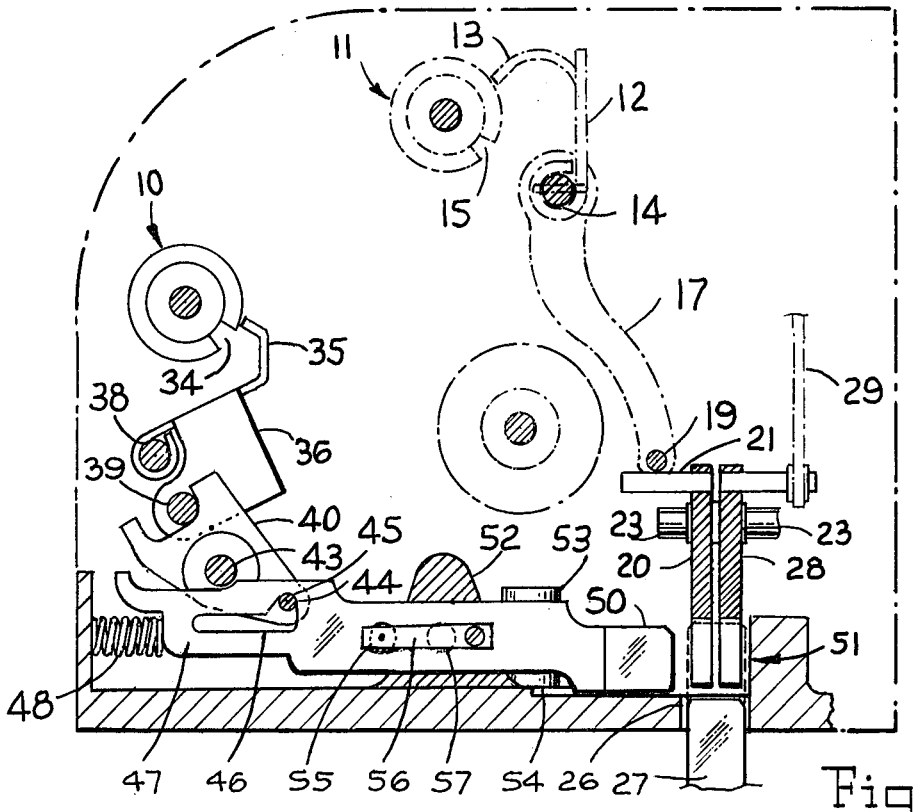
FIG. 2 is a front view of FIG. 1, with the ascending register lockout system in a position allowing the postage meter to print cycle.
Figure 3:
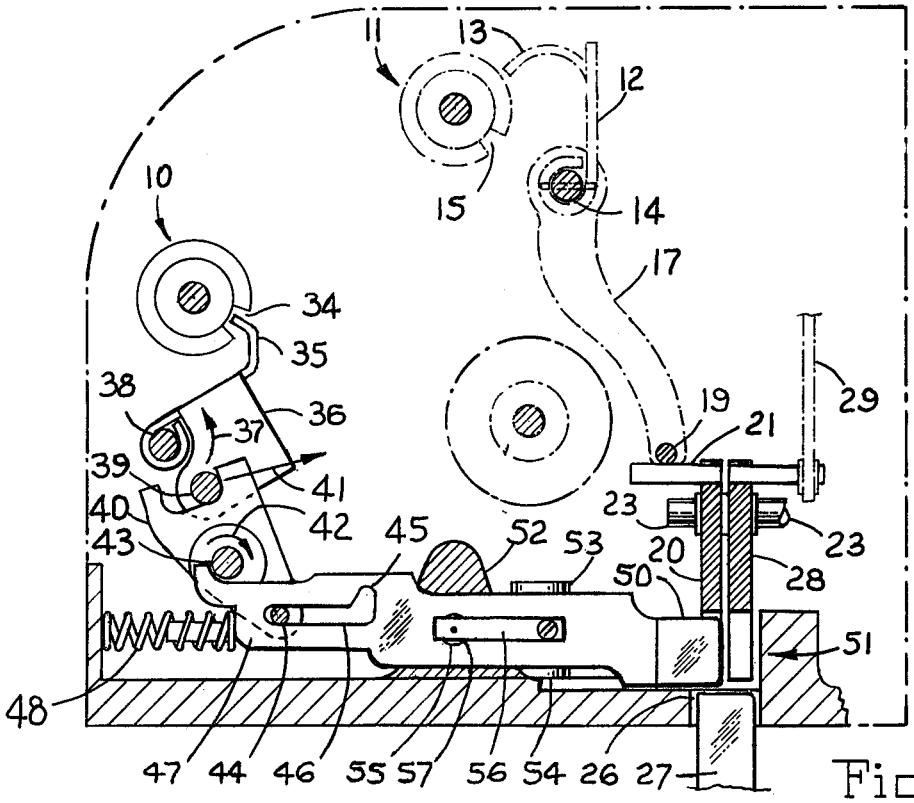
FIG. 3 is a front view of the invention similar to that of FIG. 2, showing the ascending register lockout system in a released position preventing the postage meter from print cycling.

Now referring to FIGS. 1 through 3, ascending and descending register counter lockout wheels are generally shown by respective arrows 10 and 11. Each of the registers operate, and are constructed in the standard fashion, consistant with that shown in postage meter Model RF Series; manufactured by Pitney-Bowes, Inc., Stamford, Conn. Unless otherwise stated, all functions and constructions shown for this invention, will be consistent with the internal mechanism of the aforementioned postage meter.

A locking comb 12 having teeth 13 is pivotably affixed to a rotatable shaft 14. The notches 15 of the descending register counter lockout wheel 11 align themselves, when the descending register reaches a position wherein the funds available are less than the greatest postage capable of being printed. When so aligned, the teeth 13 of comb 12 will drop into notches 15. This in turn, will cause shaft 14 to rotate (arrow 16), causing link 17 to pivot upward (arrow 18). A pin 19 carried by link 17 normally holds cam 20 in a locked position by pressing against pin 21 carried by the cam. Cam 20 is spring biased by tension spring 22, and therefore, tends to pivot (arrow 24) about shaft 23, when pin 21 is set free.

When cam 20 pivots (arrow 24) about shaft 23, a rear section 25 of the cam will block the shutter bar window 26. A shutter bar 27 is normally projected through the window 26 for each postage printing cycle (every time postage is printed). The shutter bar 27 controls a clutch (not shown), that engages the printing drum to a drive motor (also not shown).

When cam 20 is caused to block window 26, the shutter bar 27 will not be projected through the window 26, and the printing cycle will not be initiated. Therefore, when the descending register indicates that there is no more funds (meter needs to be recharged), the postage meter is "locked out" (will not print postage).

A second cam 28 disposed adjacent to cam 20 is a "dollar lock out" cam, i.e., a bar against printing postage over a dollar in value, unless a "dollar release" lever is tripped. Cam 28 acts in the same fashion as cam 20. It too, is spring biased by a tension spring 30 to pivot (arrow 31) about shaft 23. A rear section 32 of cam 28 will block the shutter bar window 26, unless lever 29 is pushed downward (arrow 33).

The ascending register counter lockout wheels 10 will also act to block window 26, when they rotate into alignment, i.e., when notches 34 are positioned in a straight line to allow the teeth 35 of the locking comb 36 to enter. The ascending register wheels 10 will attain this position, when the postage being added into the system with each printing, causes the register to achieve its maximum reading of 9;9;9;9; etc. (or any other desired reading by varying the relationship of the notch 34 with the number value imprinted on the wheel 10).

When the teeth 35 of the comb 36 drop into the notches 34 (FIG. 3), the comb 36 is caused to pivot (arrow 37) about shaft 38 by torsion spring 58, FIG. 1. A camming shaft 39 is carried by comb 36, and cams a triggering sear 40, when the comb 36 pivots. When the triggering sear 40 is cammed (arrow 41) by shaft 39, it is caused to pivot (arrow 42) about shaft 43.

A triggering pin 44 carried by the sear 40 normally rests in a detent portion 45 of a slot 46 disposed in a slide bar 47 (see FIGS. 1 and 2). When the sear 40 is cammed (pivots about shaft 43), the triggering pin 44 is caused to slip out of the detented portion 45 of slot 46 as shown in FIG. 3.

The slide bar 47 is biased by a compression spring 48 for sliding movement towards (arrow 49) window 26. The slide bar 47 is held in check against this movement, however, when pin 44 is disposed in the detent section 45 (FIGS. 1 and 2).

When the ascending register reaches its "lock out" position, pin 44 releases slide bar 47 for sliding movement (arrow 49). The nose 50 of the bar will slide through the notch 51 in cam 20 and block the window 26. Again, the shutter bar 27 will not be able to be projected upward through the window 26, and a printing cycle will not be initiated. Thus, it will be seen, that a "lock out" has been provided for the ascending register.

In the normal course of operation, the postage meter will increment the ascending register before decrementing the descending register. As such, should both lock out devices be caused to be actuated, the slide bar 47 would push "home" first (ahead of the pivoting cam 20). This will prevent cam 20 from moving to its final blocking position, but this will, however, cause no harm to the system.

The slide bar 47 is guided by a vertical post 52 and two horizontal guide members 53 and 54, respectively. This will insure proper receipt of nose 50 within the notch 51.

When the slide bar 47 slides "home" (FIG. 3), a detent pin 55 (shown in better detail in FIG. 1) carried on a leaf spring 56 affixed to bar 47, will seat in aperture 57 in the vertical guide post 52. This detent pin 55 will "lock" the slide bar 47 in the "lock out" position, thus further insuring the need for resetting the meter.

Having thus described the invention, it will be observed that the aforementioned objects have been met.

Naturally many changes can be made consistant with the objects of the invention. All modifications that would be obvious to the skilled practitioner in this art, are deemed to lie within the spirit and scope of the invention, and those limits defined by the appended claims.

What is claimed is:

1. An ascending register lockout system for a postage meter, comprising:

an elongated slide bar member mounted within said postage meter for slidable movement between a meter lockout position, and a meter operative position;

biasing means disposed within said meter and acting upon said slide bar member for biasing said slide bar member to said meter lockout position;

a triggering sear disposed within said meter adjacent said slide bar member and movable between a slide bar member holding position and a slide bar member releasing position;

an ascending register disposed within said meter and comprising at least one rotatable counter lockout wheel having a lockout notch; and a locking comb disposed adjacent said ascending register and having at least one locking tooth for receipt within said lockout notch of the counter lockout wheel when said counter lockout wheel attains a lockout value position, said locking comb being pivotably mounted within said postage meter and being pivotable to a lockout position when said locking tooth is received within said lockout notch, said locking comb further comprising camming means for camming said triggering sear from said slide bar member holding position when said locking comb is caused to pivot.

2. The ascending register lockout system of claim 1, wherein said sear carries a pin and said elongated slide bar member has a slot with a detent portion for receiving said pin carried by said sear, said sear being caused to be cammed by said locking comb, and said sear pin being caused to move from the detent portion of said slot, when said comb is caused to pivot, whereby the slide bar member is released from its meter operative position, and moves to its meter lockout position under the biasing influence of said biasing means.

3. The ascending register lockout system of claim 1, wherein the slide bar member carries a detent means for locking the slide bar member in the meter lockout position.

4. The ascending register lockout system of claim 1, further comprising means defining a lockout window, said slide bar member blocking said lockout window when in the meter lockout position.

5. An ascending register lockout system for a postage meter, comprising:

an elongated slide bar member mounted within said postage meter for slidable movement between a meter lockout position, and a meter operative position;

biasing means disposed within said meter and acting upon said slide bar member for biasing said slide bar member to said meter lockout position;

a triggering sear disposed within said meter adjacent said slide bar member and movable between a slide bar member holding position and a slide bar member releasing position;

an ascending register disposed within said meter and comprising a plurality of rotatable counter lockout wheels each having a lockout notch; and a locking comb disposed adjacent said ascending register and having a plurality of locking teeth, each one of the teeth being received within a corresponding lockout notch of the counter lockout wheels when said counter lockout wheels attain a lockout value position, said locking comb being pivotably mounted within said postage meter and being pivotable to a lockout position when said locking teeth are received within the respective lockout notches, said locking comb further comprising camming means for camming said triggering sear from said slide bar member holding position when said locking comb is caused to pivot.

6. The ascending register lockout system of claim 5, wherein said sear carries a pin and said elongated slide bar member has a slot with a detent portion for receiving said pin carried by said sear, said sear being caused to be cammed by said locking comb, and said sear pin being caused to move from the detent portion of said slot, when said comb is caused to pivot, whereby the slide bar member is released from its meter operative position, and moves to its meter lockout position under the biasing influence of said biasing means.

7. The ascending register lockout system of claim 5, wherein the slide bar member carries a detent means for locking the slide bar member in the meter lockout position.

8. The ascending register lockout system of claim 5, further comprising means defining a lockout window, said slide bar member blocking said lockout window when in the meter lockout position.

9. A postage meter comprising in combination:

an ascending register disposed within the postage meter and including a number of counter lockout wheels for registering a running total amount of postage being printed by the postage meter;

a descending register disposed within the postage meter and including a number of counter lockout wheels for registering an amount of postage being decremented with each postage printing;

a postage printing release mechanism for allowing for the printing of a postage meter mark by a postage printing means;

a first lockout device disposed within the postage meter adjacent the descending register and operatively connected between the descending register and said postage printing release mechanism for disabling the postage printing release mechanism when said descending register reaches a postage value lockout position; and a second lockout device disposed within the postage meter adjacent the ascending register and operatively connected between the ascending register and said postage printing release mechanism for disabling the postage printing release mechanism when the ascending register reaches a postage value lockout position.

10. The postage meter combination of claim 9, wherein said first lockout device comprises a locking comb pivotably mounted adjacent the descending register counter lockout wheels and pivotable to a lockout position when the descending register counter lockout wheels reach their postage value lockout position, a linkage connected to said locking comb for pivotable movement when said locking comb is caused to pivot, and a pivotable locking cam that is hèld in a meter operative position by said linkage and is caused to move to a meter lockout position when said linkage and said locking comb pivot.

11. The postage meter combination of claim 9, wherein said second lockout device comprises a locking comb pivotably mounted adjacent the ascending register wheels and pivotable to a lockout position when the ascending register counter lockout wheels reach a postage value lockout position, a pivotable triggering sear disposed adjacent said locking comb and being engageable with said locking comb, said sear being caused to pivot when said locking comb is caused to pivot, and a slide bar member disposed in adjacent engagement with said triggering sear and slidably movable between a postage meter operative position and a postage meter lockout position, said slide bar member being biased towards said postage meter lockout position, and being mechanically free to assume the lockout position when said triggering sear is caused to pivot.

12. The postage meter combination of claim 10, further comprising means defining a shutter bar window, said locking cam moving to block said shutter bar window in response to the pivoting of said locing comb.

13. The postage meter combination of claim 11, further comprising means defining a shutter bar window, said slide bar member blocking said shutter bar window when slidably moving to said postage meter lockout position.

14. The postage meter combination of claim 11, further comprising a detent mechanism carried by said slide bar member, said detent mechanism being operative to lock the slide bar member against further movement when said slide bar member attains the postage meter lockout position.

* * * * *